US007117848B2

(12) United States Patent
Hanasato

(10) Patent No.: US 7,117,848 B2
(45) Date of Patent: Oct. 10, 2006

(54) THROTTLE DEVICE

(75) Inventor: Maki Hanasato, Odawara (JP)

(73) Assignee: Mikuni Corporation, Tokyo (JP)

( * ) Notice: Subject to any disclaimer, the term of this patent is extended or adjusted under 35 U.S.C. 154(b) by 0 days.

(21) Appl. No.: 10/535,828

(22) PCT Filed: Nov. 19, 2003

(86) PCT No.: PCT/JP03/14694

§ 371 (c)(1),
(2), (4) Date: May 20, 2005

(87) PCT Pub. No.: WO2004/046526

PCT Pub. Date: Jun. 3, 2004

(65) Prior Publication Data

US 2006/0011168 A1 Jan. 19, 2006

(30) Foreign Application Priority Data

Nov. 20, 2002 (JP) ..... 2002-336813

(51) Int. Cl.
*F02D 9/02* (2006.01)
*F02D 11/10* (2006.01)

(52) U.S. Cl. ..... 123/396; 123/399; 123/336; 251/129.12

(58) Field of Classification Search ..... 123/336, 123/342, 361, 396, 399, 403; 251/129.11, 251/129.13; 25/129.12
See application file for complete search history.

(56) References Cited

U.S. PATENT DOCUMENTS 4,785,782 A 11/1988 Tanaka et al. ..... 123/399
5,265,572 A * 11/1993 Kadomukai et al. ..... 123/396
6,276,664 B1 8/2001 Keller ..... 251/129.12
6,763,805 B1 * 7/2004 Tokiya et al. ..... 123/399
6,986,336 B1 * 1/2006 Tanimura et al. ..... 123/361

FOREIGN PATENT DOCUMENTS

| | | |
|---|---|---|
| JP | 06-173695 A | 6/1994 |
| JP | 06-207535 A | 7/1994 |
| JP | 08-218904 A | 8/1996 |
| JP | 08-218945 A | 8/1996 |
| JP | 2528414 Y2 | 12/1996 |
| JP | 2982456 | 9/1999 |
| JP | 2000-097054 A | 4/2000 |
| JP | 3240506 | 10/2001 |

* cited by examiner

*Primary Examiner*—Willis R. Wolfe, Jr.

(57) ABSTRACT

According to the present apparatus, there are provided throttle valves 20 that are disposed in intake passages, a throttle shaft 30 that supports the throttle valves 20 to be opened/closed, drive means 40 that rotatably drives the throttle shaft 30, and a torsion type return spring 50 that deforms in a manner interlocked with the turn of the throttle shaft 30, and returns the throttle valves 20 to a rest position on a close side, and a deformation force transmission mechanism 60 including a speed reducing gear 62 is provided to cause a torsion deformation on the return spring 50 within an angular range smaller than the rotation angle range of the throttle shaft 30. As a result, the maximum energizing force is reduced. Consequently, the maximum energizing force of the return spring is reduced on the throttle apparatus where the throttle valves are returned to the rest position by the return spring.

12 Claims, 6 Drawing Sheets

THROTTLE DEVICE

TECHNICAL FIELD

The present invention relates to a throttle apparatus including throttle valves that open/close intake passages of an engine, and more particularly relates to a throttle apparatus including a return spring that returns throttle valves to a predetermined rest position.

BACKGROUND ART

A throttle apparatus of dual cable/electronic control type, and a throttle apparatus of single electronic control type have been known as conventional throttle apparatuses applied to engines installed on four-wheeled vehicles.

For example, on an intake system provided with two surge tanks which are used to combine each three intake passages corresponding to respective cylinders on a V-type six-cylinder engine, and intake passages extending upstream from the respective surge tanks, the conventional dual-cable/electronic-controlled throttle apparatus interlocks two throttle valves with each other, which are disposed in the respective upstream intake passages, by means of a single throttle shaft, thereby driving the throttle valves to be opened/closed by means of a cable or a motor, and provides a return spring around the throttle shaft to return the throttle valves to a rest position on the close side (refer to patent document 1, for example).

The conventional electronic-controlled throttle apparatus rotatably combines throttle valves, which are disposed respectively in two intake passages formed on throttle body, by means of a single throttle shaft, thereby driving the throttle valves to be opened/closed by means of a motor disposed on one end of the throttle shaft, and returns the throttle valves to a rest position on the close side by means of a return spring disposed on the other end of the throttle shaft (refer to patent document 2, for example).

[Patent document 1]

Japanese Laid-Open Patent Publication (Kokai) No. H6-207535

[Patent document 2]

Japanese Laid-Open Patent Publication (Kokai) No. H8-218904

If the throttle shaft, namely the throttle valves are rotated toward the fully open side by means of the cable or the driving force of the motor on the above-mentioned apparatuses, the energizing force of the return spring increases from an initial set value (initial set force) Fo to the maximum value Fmax in proportional to the increase of the rotation angle θ as shown in FIG. 6.

On the other hand, as the energizing force required to return the throttle valves to the rest position on the close side, in consideration of the slide resistance of the cable or the rotation resistance and the like of the motor, although the initial set value Fo+α (<Fmax) is enough, the energizing force reaches the maximum value Fmax due to the characteristic of being proportional to the deformation quantity.

As a result, the load applied on the cable or the motor increases, and the operability degrades upon the drive by the cable, or the power consumption increases, or the size of the motor, consequently the size of the entire apparatus increases upon the drive by the motor.

The present invention is devised in view of the problems of the above-mentioned prior art, and has an object of providing a throttle apparatus which, for a configuration provided with a return spring that returns throttle valves, which are provided in intake passages, and carry out open/close operations, to a rest position, secures smooth open/close operations and a return operation while the maximum energizing force of a return spring is reduced, improves the operability, reduces the power consumption especially upon the open/close drive by means of a motor, reduces the size of the apparatus, and provides other advantages.

DISCLOSURE OF THE INVENTION

A throttle apparatus according to the present invention including a throttle valve that is disposed in an intake passage of an engine, a throttle shaft that supports the throttle valve to be opened/closed, drive means that rotatably drives the throttle shaft, and a return spring that deforms in a manner interlocked with the turn of the throttle shaft, and returns the throttle valve to a predetermined rest position, characterized in that: there is provided a deformation force transmission mechanism that communicates with the throttle shaft, and rotates according to the rotation of the throttle shaft within an angular range smaller than the rotation angle range of the throttle shaft, and one end of said return spring is held by the deformation force transmission mechanism to cause a deformation on the return spring according to the rotation angle of the deformation force transmission mechanism.

With this configuration, if the drive means rotates the throttle shaft within the predetermined angle range, the throttle valve rotates within the predetermined angle range (from the rest position to the maximum open position). On this occasion, the deformation force transmission mechanism causes the deformation on the return spring (an extension deformation corresponding to angle x turning radius for an extension type return spring, or a torsion deformation corresponding to a torsion angle for a torsion type return spring, for example) within the angle range smaller than the rotation angle range of the throttle shaft.

As a result, the maximum energizing force of the return spring becomes smaller than the case where the return spring is deformed within the same angle range as the rotation angle range of the throttle shaft, and the load applied to the drive means thus is reduced.

The above-mentioned configuration may employ such a configuration that the return spring is a torsion type return spring that generates an energizing force upon a torsion deformation.

With this configuration, since the energizing force is generated by simply disposing the return spring around a rotation shaft or the like to generate the torsion deformation, the structure is simplified by this configuration in conjunction with the deformation force transmission mechanism.

The above-mentioned configurations may employ such a configuration that the return spring includes multiple return springs that apply an energizing force different from each other, and the deformation force transmission mechanism is provided for at least a return spring which applies the largest energizing force.

With this configuration, since the multiple energizing force can be applied to the throttle shaft at separated positions in the axial direction, the return operation can be more surely carried out, and the maximum energizing force can be reduced.

The above-mentioned configurations may employ such a configuration that the drive means includes a motor, and a gear train that transmits the driving force of the motor to the throttle shaft.

With this configuration, since the deformation force transmission mechanism reduces the load applied to the motor, the power consumption is reduced, and the size of the motor, consequently the size of the apparatus is reduced.

The above-mentioned configuration may employ such a configuration that the gear train includes a first gear fixed to the throttle shaft, and the deformation force transmission mechanism includes a speed reducing gear which reduces the rotational speed of the first gear (namely outputs the rotational speed lower than the rotational speed of the first gear), and deforms the return spring.

With this configuration, since the deformation force transmission mechanism is formed by the gear mechanism including the speed reducing gear, upon disposing the deformation force transmission mechanism while being meshed with the first gear, it is possible to freely dispose the deformation force transmission mechanism without interference with parts disposed close to the first gear.

The above-mentioned configuration may employ such a configuration that the first gear includes a large gear to which the driving force of the motor is transmitted, and a small gear smaller in diameter than the large gear, and the speed reducing gear is formed so as to be larger in diameter than the small gear, and to directly mesh with the small gear.

With this configuration, since the speed reducing gear is larger in diameter than the small gear, the deformation quantity of the return spring can be reduced, and the size of the return spring can be reduced, thereby reducing the size of the entire apparatus.

The above-mentioned configurations may employ such a configuration that the throttle shaft supports multiple throttle valves.

With this configuration, although the multiple throttle valves are supported, and the initial set force and the spring constant of the return spring are thus generally large, since the deformation force transmission mechanism reduces the maximum energizing force, the load applied to the drive means is reduced, thereby providing smooth open/close operations.

BEST MODE FOR CARRYING OUT THE INVENTION

A description will now be given of embodiments of the present invention with reference to accompanying drawings.

Figure 1:
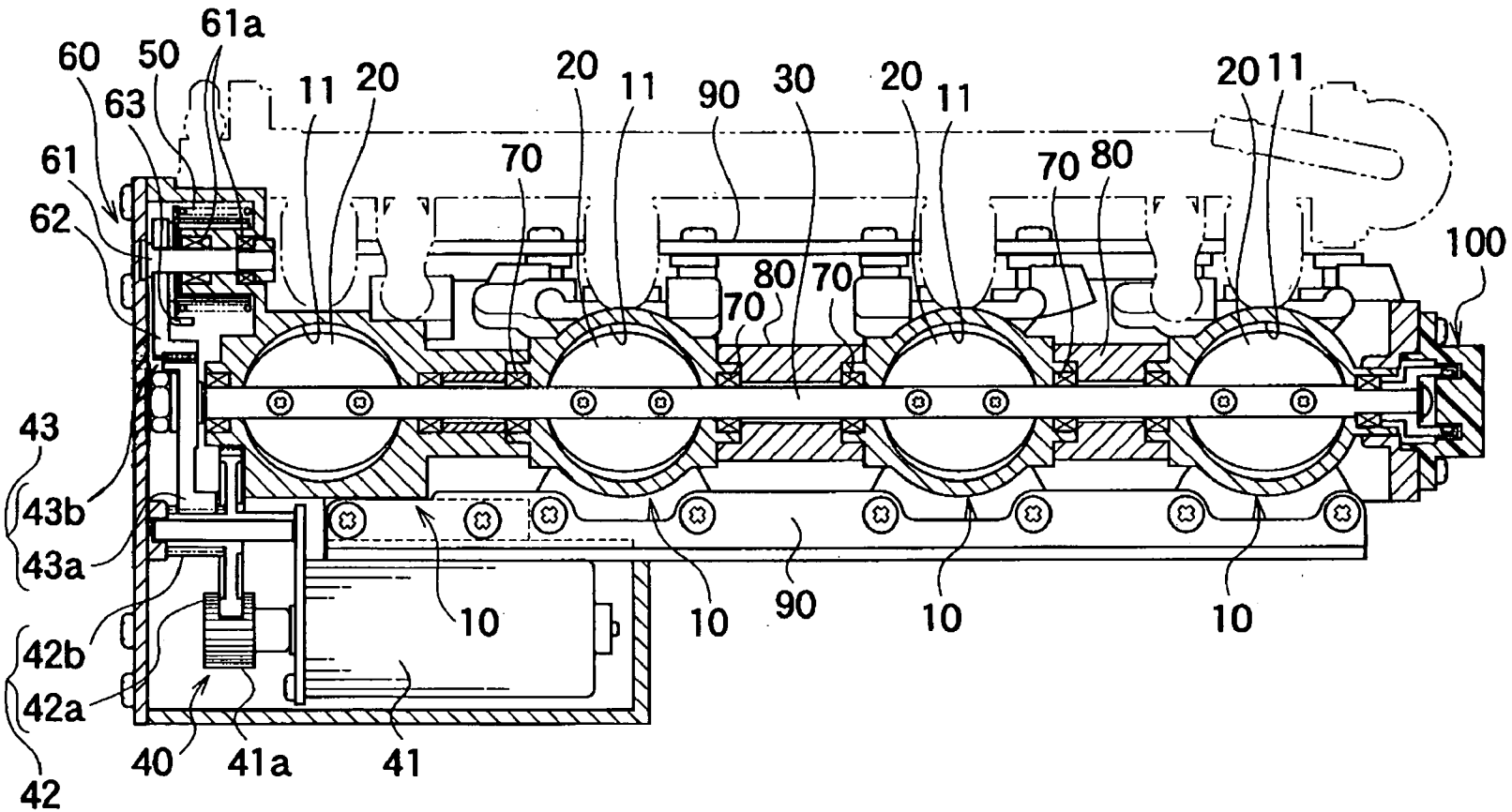
FIG. 1 is a configuration schematic showing an embodiment of a throttle apparatus according to the present invention.
Figure 2:
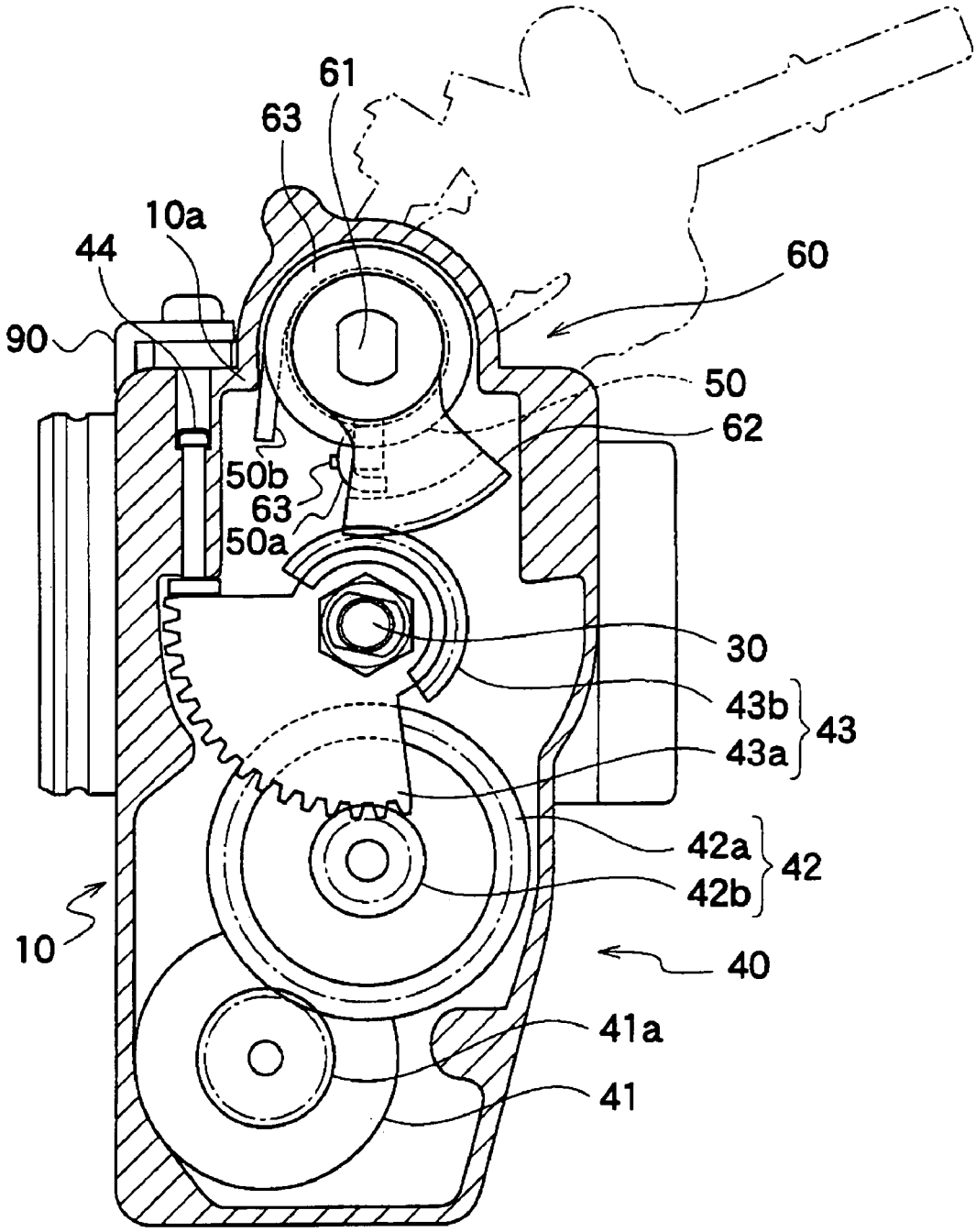
FIG. 2 is a side view showing drive means and a deformation force transmission mechanism of the apparatus shown in FIG. 1.

FIG. 1 and FIG. 2 show an embodiment of a throttle apparatus according to the present invention, FIG. 1 is a configuration schematic, and FIG. 2 is a side view of drive means and a deformation force transmission mechanism.

This apparatus is a four-throttle apparatus applied to an inline four-cylinder engine installed on a two-wheeled vehicle, and, as shown in FIG. 1, is provided with four throttle bodies 10 that define intake passages 11, four throttle valves 20 that are disposed in the intake passages 11, a throttle shaft 30 that rotatably supports the four throttle valves 20 to be simultaneously opened/closed, the drive means 40 that rotatably drives the throttle shaft 30, a torsion type return spring 50 that returns the throttle valves 20 to a predetermined rest position, the deformation force transmission mechanism 60 that transmits a torsional deformation force to the return spring 50, and the like.

It should be noted that this apparatus is provided with, as additional constitutions, bearings 70 that rotatably support the throttle shaft 30, spacers 80 that connect the throttle bodies 10 with each other, a connection frames 90 that connect the four throttle bodies 10, an angle detection sensor 100 that detects the rotation angle of the throttle shaft 30, and the like.

The drive means 40, as shown in FIG. 1 and FIG. 2, is formed by a DC motor 41 that includes a pinion 41*a*, a gear 42 that integrally includes a large gear 42*a* that meshes with the pinion 41*a*, and a small gear 42*b*, a gear 43 that serves as a first gear that meshes with the gear 42 (small gear 42*b*), and is fixed to the throttle shaft 30, an adjust screw 44 that restricts a rotation end (angular position) of the gear 43, and the like.

The gear 43, as shown in FIG. 1 and FIG. 2, is formed so as to be integrally provided with a large gear 43*a* of a large diameter that meshes with the gear 42 (small gear 42*b*), and a small gear 43*b* that is smaller in diameter than the large gear 43*a* across the respective center angles (angular ranges).

If the DC motor 41 rotates, the rotational driving force thereof is transmitted from the pinion 41*a* to the throttle shaft 30 via a gear train (gears 42, 43). The throttle shaft 30 then turns within a predetermined rotation angle range, and the throttle valves 20 thus carry out the open/close operations within a range from a predetermined rest position to the maximum open position.

The deformation force transmission mechanism 60, as shown in FIG. 1 and FIG. 2, is formed by a rotation shaft 61 that is supported on the throttle body 10 by bearings 61*a*, a speed reducing gear 62 that is supported to integrally rotate with the rotation shaft 61, and directly meshes with the gear 43 (small gear 43*b*), a holding member 63 that rotates integrally with the speed reducing gear 62, and the like. In this configuration, the speed reducing gear 62 is formed larger in diameter than the small gear 43*b*.

Namely, if the number of teeth of the gear 43*b* is $Z_{43}$, and the number of teeth of the speed reducing gear 62 is $Z_{62}$ ($Z_{43}<Z_{62}$), upon the rotational force being transmitted from the gear 43 to the speed reducing gear 62, the rotational speed $N_{43}$ of the gear 43 is reduced by the speed reducing gear 62, and the rotation shaft 61 and the speed reducing gear 62 rotate at a rotational speed $N_{62}$ ($=N_{43}\times(Z_{43}/Z_{62})$) $<N_{43}$. Accordingly, if the gear 43 rotates by a predetermined angle $\theta_{max}$, the speed reducing gear 62 rotates by an angle $\theta_m$ ($=\theta_{max}\times(Z_{43}/Z_{62})$) smaller than the angel $\theta_{max}$.

On the other hand, upon the rotational force being transmitted from the speed reducing gear 62 to the gear 43, the rotational speed $N_{62}$ of the speed reducing gear 62 is increased by the gear 43, and the throttle shaft 30 rotates at the rotational speed $N_{43}$ ($=N_{62}\times(Z_{62}/Z_{43})$)$>N_{62}$.

In this way, since the deformation force transmission mechanism 60 is formed by the gear mechanism including the speed reducing gear 62, upon disposing the deformation force transmission mechanism 60 while being meshed with the gear 43, it is possible to freely dispose the deformation force transmission mechanism 60 without interference with parts disposed close to the gear 43. Moreover, since the speed reducing gear 62 is larger in diameter than the small gear 43b, the deformation quantity of the return spring 50 deformed by the speed reducing gear 62 can be smaller, and the size of the return spring 50 can be smaller, resulting in a reduction of the size of the entire apparatus.

The return spring 50, as shown in FIG. 1 and FIG. 2, is disposed around the rotation shaft 61, one end 50*a* thereof is held on the holding member 63, and the other end 50*b* thereof is held on a holding section 10*a* of the throttle body 10. The return spring 50 thus applies the energizing force generated by the torsion deformation around the rotation shaft 61 to rotate the speed reducing gear 62 counterclockwise in FIG. 2.

On this occasion, if the speed reducing gear 62 is positioned at a counterclockwise rotation end in FIG. 2, namely the gear 43 is positioned at a clockwise rotation end, the throttle valves 20 are positioned at the rest position on the close side. On this occasion, the return spring 50 is attached in a state preforming a torsion deformation to generate an energizing force (initial set force) Fo.

If the gear 43 (throttle shaft 30) then rotates counterclockwise by a predetermined angle (θmax) in FIG. 2, the speed reducing gear 62 rotates clockwise by an angle θm (<θmax) to generate a torsion deformation on the return spring 50.

Namely, the deformation force transmission mechanism 60 generates the torsion deformation on the return spring 50 within the small angle range (θm) smaller than the rotation angle range (θmax) of the throttle shaft 30.

A description will now be given of the operation of the deformation force transmission mechanism 60 based on FIG. 3, and if the gear 43 (throttle shaft 30) and the speed reducing gear 62 are at the rest position (rotation angle θ=0), the energizing force F of the return spring 50 is Fo.

If the gear 43 (throttle shaft 30) rotates by the angle θmax, which positions the throttle valves 20 to the maximum opening from this state, the speed reducing gear 62 rotates by the angle θm (<θmax), and the energizing force F of the return spring 50 thus increases linearly as indicated by f1 to reach the maximum energizing force Fmax.

Figure 3:
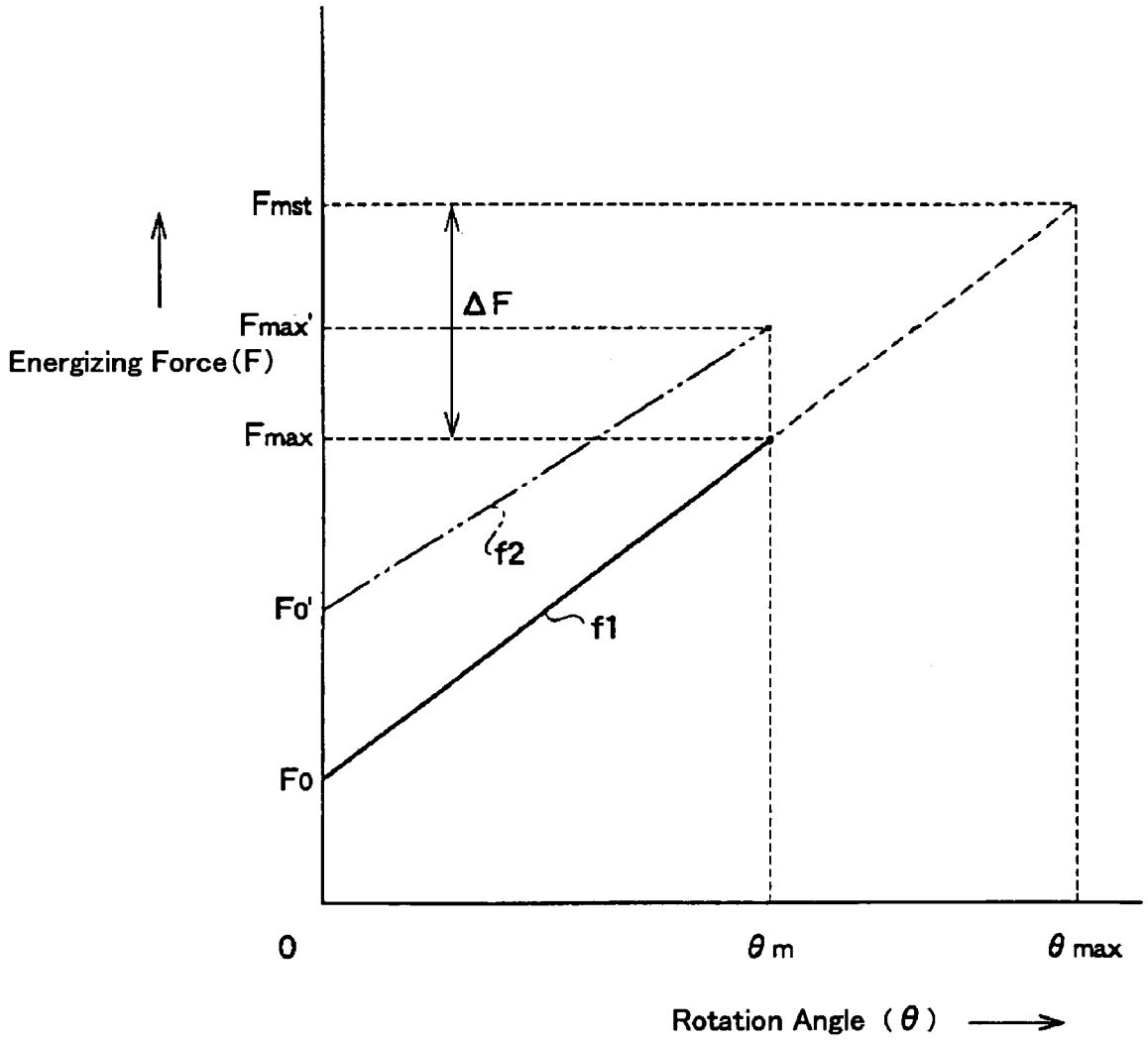
FIG. 3 is a chart describing an action of the deformation force transmission mechanism of the apparatus shown in FIG. 1.

If the return spring 50 rotates by the same angle θmax as the throttle shaft 30, the energizing force F increases further as a dotted line in FIG. 3 shows, and reaches Fmst (>Fmax). Namely, the energizing force F of the return spring 50 is reduced by ΔF (=Fmst−Fmax) due to the operation of the deformation force transmission mechanism 60 in the state where the throttle valves 20 have reached the maximum opening.

As a result, at the maximum opening position, since the energizing force F of the return spring 50 is reduced by ΔF, and the torque required to rotate the gear 43 against the energizing force of the return spring 50 is reduced according to the value of $Z_{43}/Z_{62}$, the load applied on the DC motor 41 is reduced, the power consumption is thus reduced, and the throttle operation can be carried out smoothly.

On the other hand, upon the drive by the DC motor 41 being stopped, and the throttle valves 20 thus being returned to the rest position on the close side by the energizing force of the return spring 50, since the rotational force is transmitted from the speed reducing gear 62 to the gear 43 while the speed is increased according to the value of $Z_{62}/Z_{43}$, the throttle shaft 30 (and the throttle valves 20) quickly rotates to return to the rest position.

As described above, since the maximum energizing force is reduced, if the initial set force of the return spring 50 is set to Fo' (>Fo), and the maximum energizing force is set to Fmax' (Fmax<Fmax'<Fmst), the throttle operation is further smoothed, a reduction of the power consumption and the like are achieved, and the return operation as a whole can be carried out quickly at the same time. Moreover, even if the spring constant is reduced, and the initial set force (energizing force) is increased, the same effect is obtained.

A description will now be given of the operation of the above-mentioned throttle apparatus as a whole.

If the DC motor 41 rotates in one direction based on a control signal transmitted from a control unit, the rotational driving force is transmitted to the throttle shaft 30 via the gear train (pinion 41*a*, gear 42, large gear 43*a*), the rotation of the gear 43*b* is reduced, and is transmitted to the speed reducing gear 62, and the speed reducing gear 62 causes the torsion deformation on the return spring 50.

The throttle shaft 30 then starts to rotate in the one direction against the increasing energizing force of the return sprint 50, and the throttle valves 20 rotate from the rest position to the maximum open position to fully open the intake passages 11. At this maximum open position, as described above, since the maximum energizing force Fmax of the return spring 50 is reduced by ΔF compared with the conventional case, and the torque required to rotate the gear 43 against the energizing force of the return spring 50 can be small, the throttle operation to reach this position is carried out smoothly, and the power consumption of the DC motor 41 is reduced.

On the other hand, if the DC motor 41 rotates in the opposite direction based on the control signal from the control unit, the throttle shaft 30 rotates in the opposite direction routing along the reverse course while the energizing force F of the return spring 50 is applied, and the throttle valves 20 rotate from the maximum open position to the rest position, which closes the intake passages 11.

In the normal operation, the rotation of the DC motor 41 is properly controlled according to the control mode, and the throttle valves 20 are driven to be opened/closed to attain an optimal opening. If the DC motor 41 stops, since the rotational force is transmitted from the speed reducing gear 62 to the gear 43 by the energizing force F of the return spring 50 while the speed is increased, the throttle shaft 30 quickly rotates to return the throttle valves 20 to the rest position.

Figure 4:
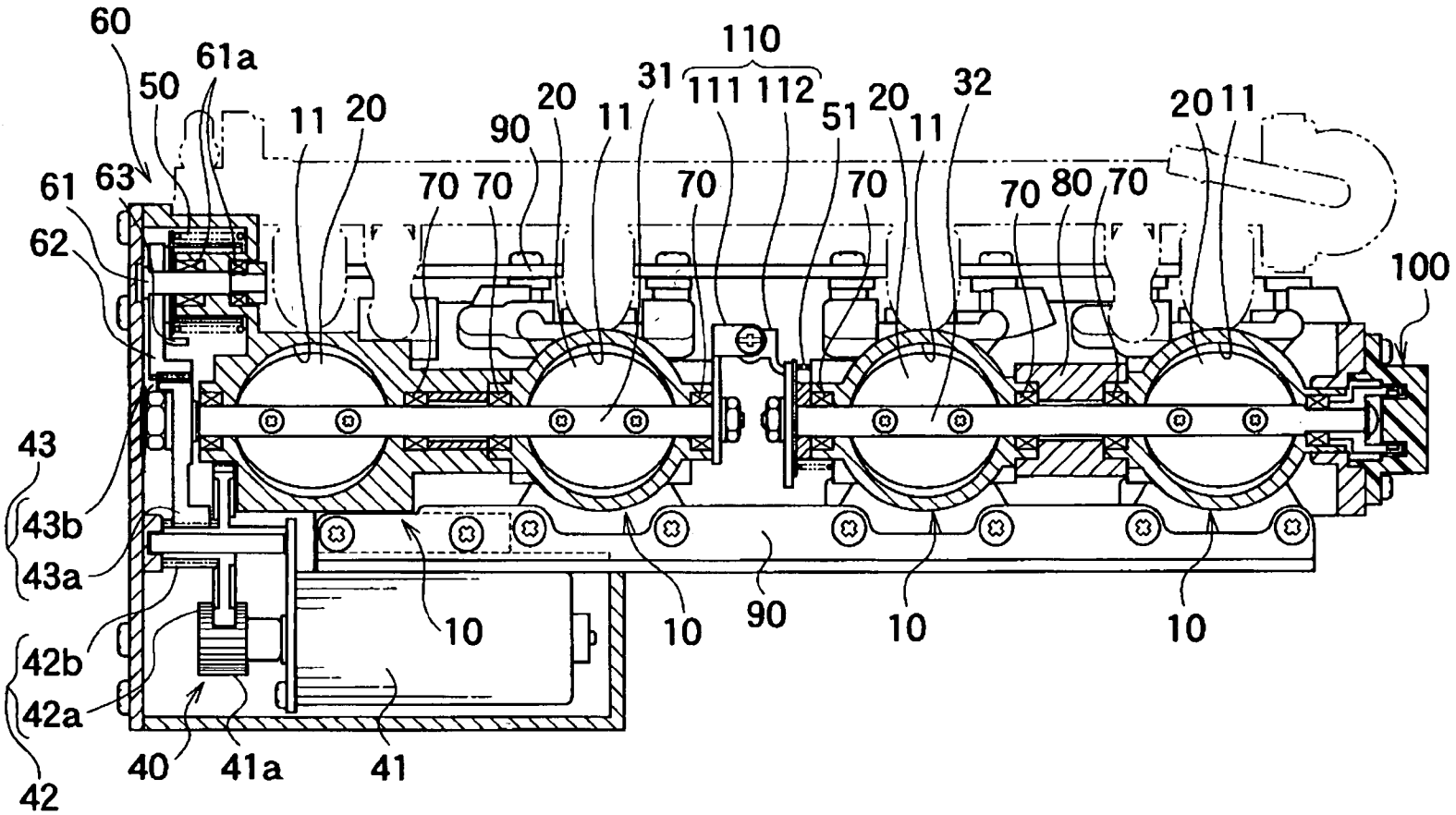
FIG. 4 is a configuration schematic showing another embodiment of the throttle apparatus according to the present invention.

FIG. 4 shows another embodiment of the throttle apparatus according to the present invention, which employs two-divided throttle shafts 31, 32 in place of the throttle shaft 30 of the above-mentioned embodiment, connects both of them with each other by means of a synchronization lever 110 (111, 112), and employs two return springs 50, 51. Like components are denoted by like numerals as of the above-mentioned embodiment, and will be explained in no more details.

This apparatus includes throttle shafts 31, 32 separated into two in the approximate center to simultaneously open/close the each two throttle valves 20 as shown in FIG. 4, and is formed such that both of them are connected by the synchronization lever 110 to rotate coaxially in an interlocked manner.

As the return springs, two springs 50, 51 generating energizing forces different from each other are employed. The return spring 50 generates a larger energizing force than the other return spring 51.

The return spring 50 is disposed at the position of the deformation force transmission mechanism 60 as in the above-mentioned embodiment. On the other hand, the other return spring 51 generates a relatively small energizing force which is sufficient for returning the two throttle valves 20 on the right side, and is disposed close to the one synchronization lever 112 fixed to the throttle shaft 32. Namely, the return spring 51 produces a torsion deformation within the same angle range as the rotation angle range of the throttle shafts 31, 32.

Providing two return springs 50, 51 exerting the energizing force different from each other, especially disposing the return spring 51 with the smaller energizing force at the approximately middle area of the throttle shafts 31, 32, which is separated from the drive means 40, in this way prevents the torsions of the throttle shafts 31, 32, and realizes a more smooth return operation.

A description will now be given of the operations of the deformation force transmission mechanism 60 and the two return springs 50, 51 based on FIG. 5, and if the gear 43 (throttle shafts 31, 32) and the speed reducing gear 62 are at the rest position (rotation angle $\theta=0$), the energizing force F of the return spring 50 is Fo1, and the energizing force F of the return spring 51 is Fo2.

If the gear 43 (throttle shafts 31, 32) rotates by the angle $\theta max$, which positions the throttle valves 20 to the maximum opening from this state, the speed reducing gear 62 rotates by the angle $\theta m$ ($<\theta max$), the energizing force F of the return spring 50 thus increases linearly as indicated by f1 to reach the maximum energizing force Fmax1, and the energizing force F of the return spring 51 thus increases linearly as indicated by f2 to reach the maximum energizing force Fmax2.

Figure 5:
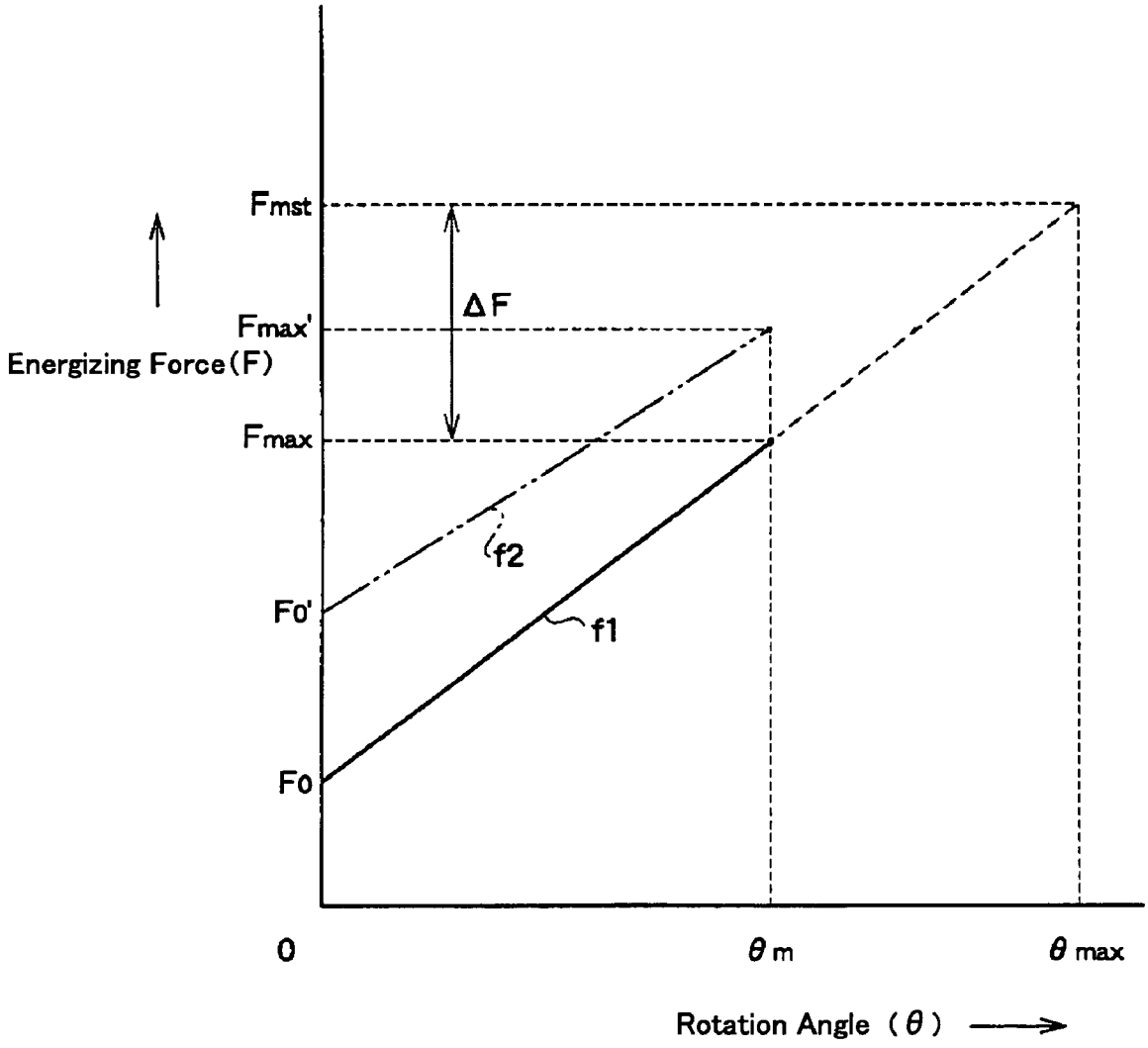
FIG. 5 is a chart describing an action of the deformation force transmission mechanism of the apparatus shown in FIG. 4.
Figure 6:
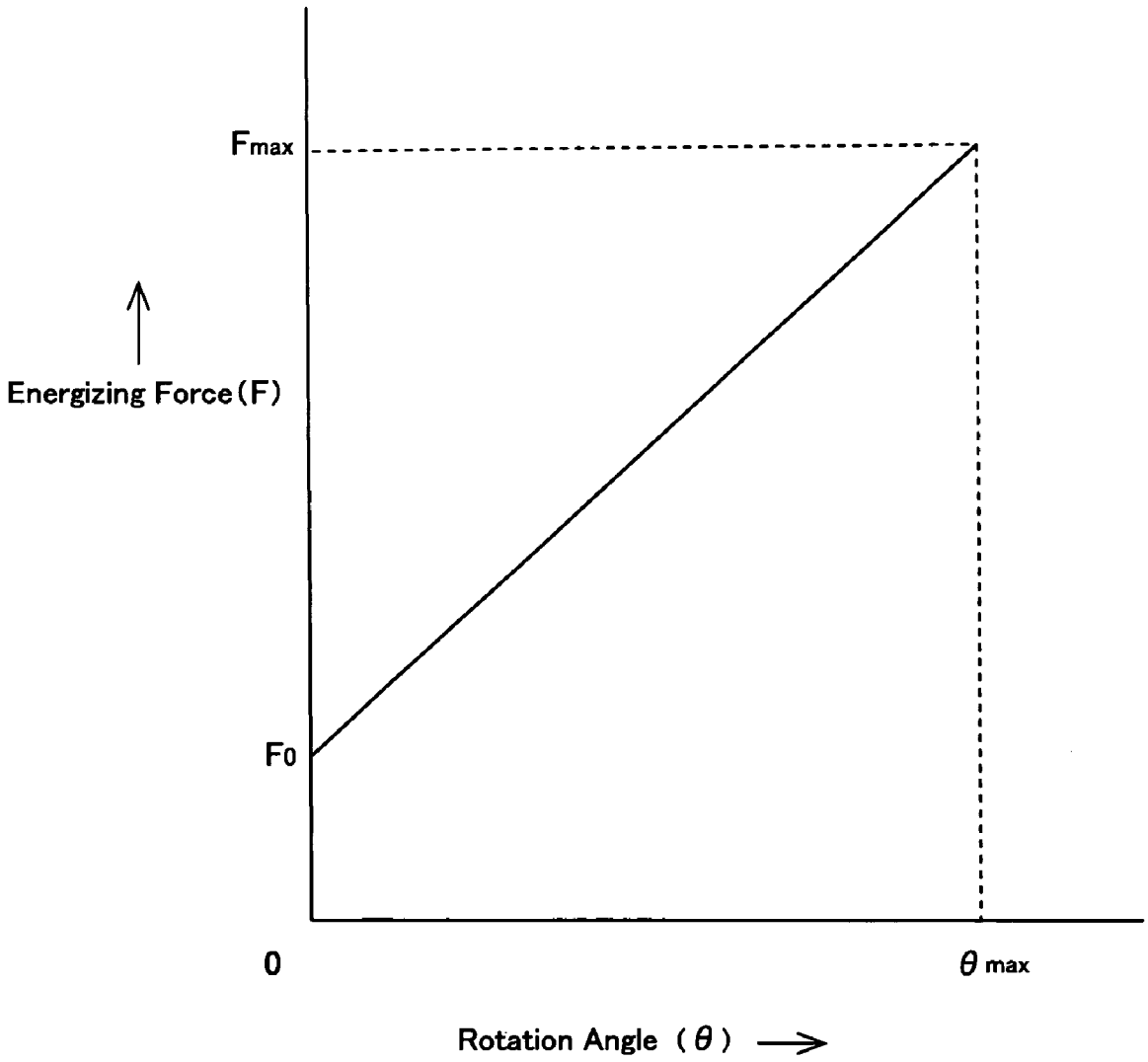
FIG. 6 is a chart showing an action of a return spring of a conventional throttle apparatus.

If the return spring 50 rotates by the same angle $\theta max$ as the throttle shaft 30, the energizing force F increases further as a dotted line in FIG. 5 shows, and reaches Fmax1' (>Fmax1). Namely, the energizing force F of the return spring 50 is reduced by $\Delta F$ (=Fmax1'−Fmax1) due to the operation of the deformation force transmission mechanism 60 in the state where the throttle valves 20 have reached the maximum opening. Consequently, the energizing force as a resultant force of the return spring 50 and the return spring 51 is reduced as a whole.

As described above, the maximum energizing force (F) at this maximum open position ($\theta max$) is reduced by $\Delta F$ (=Fmax'1−Fmax1), and the torque required to rotate the gear 43 against the energizing force of the return spring 50 can be small, the throttle operation to reach this position is carried out smoothly, and the power consumption of the DC motor 41 is reduced.

The overall operation of this apparatus is similar to that of the above-mentioned embodiment except for the application of the energizing force of the return spring 51, and will thus be explained in no more details.

Although the description is given of the four-throttle apparatus where the four throttle valves 20 are integrally supported by the throttle shaft 30 (31, 32) as the multi-throttle apparatus in the above-mentioned embodiments, the configuration of the present invention is not limited to these examples, and may be employed in throttle apparatuses including a single throttle valve, or multi-throttle apparatuses such as three-, or five or more-throttle apparatus.

Also, although the description is given of the case where the deformation force transmission mechanism 60 is applied to the torsion type return spring 50 as the return spring in the above-mentioned embodiments, the configuration is not limited to these examples, and the deformation force transmission mechanism 60 may be employed in a configuration where an extension type return spring, a pulley integrally provided with the speed reducing gear, and the like are provided, and the rotation of the speed reducing gear causes an extension deformation.

Further, although, as the drive means which rotationally drives the throttle shaft 30, there is employed the configuration that the intermediate gear 42 is meshed between the DC motor 41 (pinion 41*a*) and the gear 43 (large gear 43*a*) in the above-described embodiments, the configuration is not limited to these examples, and since the load applied to the DC motor 41 is reduced, there may be employed such a configuration that the DC motor 41 (pinion 41*a*) directly meshes with the gear 43 (large gear 43*a*).

INDUSTRIAL APPLICABILITY

As described above, with the throttle apparatus according to the present invention, in the configuration provided with the return spring that deforms in the interlocked manner with the turn of the throttle shaft supporting the throttle valves, and returns the throttle valves to the predetermined rest position, within the angular range smaller than the rotation angle range of the throttle shaft, as a result of providing the deformation force transmission mechanism that generates a deformation on the return spring, the maximum energizing force of the return spring becomes smaller than a case where the return spring is deformed within the same angle range as the rotation angle range of the throttle shaft, resulting in a reduction of the load applied to the drive means. As a result, the throttle operation becomes smooth, the power consumption is reduced especially upon a motor being used as the drive means, and the size of the entire apparatus is reduced.

Further, disposing the speed reducing gear of the deformation force transmission mechanism on the rotation shaft different from the throttle shaft reduces the width of the apparatus in the axial direction of the throttle shaft, thereby reducing the size of the apparatus as a whole.

The invention claimed is:

1. A throttle apparatus comprising: a throttle valve that is disposed in an intake passage of an engine, a throttle shaft that supports said throttle valve to be opened/closed, drive means that rotatably drives said throttle shaft, and a return spring that deforms in a manner interlocked with the turn of said throttle shaft, and returns said throttle valve to a predetermined rest position, wherein there is provided a deformation force transmission mechanism that communicates with said throttle shaft, and rotates according to the rotation of said throttle shaft within an angular range smaller than the rotation angle range of said throttle shaft, and one end of said return spring is held by said deformation force transmission mechanism to cause a deformation on said return spring according to the rotation angle of said deformation force transmission mechanism.

2. The throttle apparatus according to claim 1, wherein said return spring is a torsion type return spring that generates energizing force upon a torsion deformation.

3. The throttle apparatus according to claim 1 or 2, wherein said throttle shaft supports a plurality of throttle valves.

4. The throttle apparatus according to claim 1 or 2, wherein:

said return spring includes a plurality of return springs that apply an energizing force different from each other; and said deformation force transmission mechanism is provided at least for a return spring which applies the largest energizing force.

5. The throttle apparatus according to claim 4, wherein said throttle shafts supports a plurality of throttle valves.

6. The throttle apparatus according to claim 4, wherein said drive means comprises a motor, and a gear train that transmits the driving force of said motor to said throttle shaft.

7. The throttle apparatus according to claim 1 or 2, wherein said drive means comprises a motor, and a gear train that transmits the driving force of said motor to said throttle shaft.

8. The throttle apparatus according to claim 7, wherein said throttle shafts supports a plurality of throttle valves.

9. The throttle apparatus according to claim 7, wherein said gear train comprises a first gear fixed to said throttle shaft; and said deformation force transmission mechanism comprises a speed reducing gear which reduces the rotational speed of said first gear, and deforms said return spring.

10. The throttle apparatus according to claim 9, wherein said throttle shafts supports a plurality of throttle valves.

11. The throttle apparatus according to claim 9, wherein said first gear comprises a large gear to which the driving force of said motor is transmitted, and a small gear that is smaller in diameter than said large gear; and said speed reducing gear is formed so as to be larger in diameter than said small gear, and to directly mesh with said small gear.

12. The throttle apparatus according to claim 11, wherein said throttle shafts supports a plurality of throttle valves.

* * * * *